US007391367B2

(12) United States Patent
Newberg et al.

(10) Patent No.: US 7,391,367 B2
(45) Date of Patent: Jun. 24, 2008

(54) OPTICALLY FREQUENCY GENERATED SCANNED ACTIVE ARRAY

(75) Inventors: Irwin L. Newberg, Pacific Palisades, CA (US); Steven R. Wilkinson, Stevenson Ranch, CA (US); Jar J. Lee, Irvine, CA (US); Robert A. Rosen, Simi Valley, CA (US); Kapriel V. Krikorian, Oak Park, CA (US)

(73) Assignee: Raytheon Company, Waltham, MA (US)

( * ) Notice: Subject to any disclaimer, the term of this patent is extended or adjusted under 35 U.S.C. 154(b) by 577 days.

(21) Appl. No.: 10/953,145

(22) Filed: Sep. 28, 2004

(65) Prior Publication Data

US 2006/0067709 A1 Mar. 30, 2006

(51) Int. Cl.
*H01Q 3/34* (2006.01)

(52) U.S. Cl. ..... 342/375; 398/116

(58) Field of Classification Search ..... None
See application file for complete search history.

(56) References Cited

U.S. PATENT DOCUMENTS 5,266,961 A * 11/1993 Milroy ..... 343/772
5,353,033 A * 10/1994 Newberg et al. ..... 342/375
5,475,392 A * 12/1995 Newberg et al. ..... 342/375
5,723,856 A * 3/1998 Yao et al. ..... 250/227.11
5,933,113 A * 8/1999 Newberg et al. ..... 342/375
5,999,128 A * 12/1999 Stephens et al. ..... 342/375
6,900,707 B2 * 5/2005 Erlig et al. ..... 333/156
7,027,675 B2 * 4/2006 Sayyah ..... 385/14
7,187,870 B2 * 3/2007 Ilchenko et al. ..... 398/161

OTHER PUBLICATIONS

"Optoelectronic Microwave Oscillator", by X.S. Yao and L. Maleki, published in J. Optical Society of America, vol. 13, No. I, 8, Aug. 1996, pp. 1725-1735.
"Demonstration of a Photonically Controlled RF Phase Shifter", by Sang-Shin Lee, et al., published in IEEE Microwave and Guided Wave Letters, vol. 9, No. 9, Sep. 1999.
"Optoelectronic Oscillator for Photonic Systems", by X. S. Yao and L. Maleki, published in IEEE Journal of Quantum Electronics, vol. 32, No. 7, Jul. 1996.

* cited by examiner

*Primary Examiner*—Gregory C Issing
(74) *Attorney, Agent, or Firm*—Leonard A. Alkov

(57) ABSTRACT

A system for scanning an antenna array of the present invention. The system includes a first mechanism for modulating a desired signal on an optical carrier signal. The first mechanism includes a frequency-tunable optical oscillator with a phase shifter for changing an output frequency of the optical oscillator. A second mechanism employs the optical carrier signal to derive signals having predetermined phase relationships. A third mechanism receives the feed signals and radiates corresponding transmit signals in response thereto to the antenna array to steer the array. In more specific embodiment, the desired signal is a Radio Frequency (RF) signal, and the phase shifter is an electrically controlled optical RF phase shifter. The optical carrier signal includes a first optical carrier signal and a second optical carrier signal. The frequency-tunable optical oscillator includes a first tunable optical oscillator for providing the first optical carrier signal and a second tunable optical oscillator for providing the second optical carrier signal. The first and second optical oscillators include first and second optical RF phase shifters, respectively, that include feedback paths having optical and electrical sections.

33 Claims, 4 Drawing Sheets

OPTICALLY FREQUENCY GENERATED SCANNED ACTIVE ARRAY

BACKGROUND OF THE INVENTION

1. Field of Invention

This invention relates to antennas. Specifically, the present invention relates to transceivers for active array antennas.

2. Description of the Related Art

Active array radar systems are employed in various demanding applications including missile target tracking, air traffic control, aircraft guidance, and ground mapping systems. Such applications demand reliable, efficient, and cost-effective radar systems that accurately detect and track targets.

To enhance target detection and tracking accuracy, radar systems often employ high-frequency microwaves or millimeter waves. However, millimeter waves or high-frequency microwaves may cause excessive signal losses, especially in antenna element waveguide feeds. These losses may reduce the overall target detection and tracking capability of the accompanying radar system.

Small millimeter waves require relatively complex active arrays with small components and close component spacing. Waveguides employed to feed the antenna arrays elements are bulky relative to the small active antenna array elements. This places undesirable design constraints on the active array radar system.

Conventionally, active arrays are steered by beam-pointing techniques that involve selective phase shifting of signals fed to the array. These techniques often require a phase shifter at every active array element. Unfortunately, the phase shifters are often lossy and bulky relative to the small millimeter wave antenna elements. Bulky phase shifters at every element place undesirable design constraints on the antenna arrays.

Alternatively, serpentine radio frequency waveguide feeds are employed instead of the phase shifters. Desired phase shifts are achieved by placing taps at strategic positions in the serpentine feed. Radiation from the different taps has different phase depending on tap spacing and input frequency. Unfortunately, these serpentine feeds are also undesirably complex, bulky, and lossy. Furthermore, conventional radar systems employing serpentine feeds and/or phase shifters may require separate sets of transmit/receive modules to scan or steer the radar antenna in both azimuth and elevation. The extra transmit/receive modules are bulky, expensive, and impose additional radar design constraints.

Hence, a need exists in the art for an efficient active array radar design that obviates the need for bulky and lossy antenna feeds and phase shifters. There exists a further need for an active array radar that can be scanned in azimuth and elevation with the same set of transmit/receive modules and without requiring conventional phase shifters.

SUMMARY OF THE INVENTION

The need in the art is addressed by the system for scanning an antenna array of the present invention. In the illustrative embodiment, the system is adapted for use in active radar array systems and provides the capability to scan any active array without the use of any phase shifter components at each of the array radiators, thus eliminating the need for phase shifters in the feed lines to each array radiator by using frequency tuning (changing) to steer the array.

The system includes a first mechanism for modulating a desired signal on an optical carrier signal. The first mechanism includes a frequency-tunable optical oscillator with a phase shifter for changing an output frequency of the optical oscillator. A second mechanism employs the optical carrier signal to derive signals having predetermined phase relationships. A third mechanism receives the feed signals and radiates corresponding transmit signals in response thereto to the antenna array to steer the array.

In more specific embodiment, the desired signal is a Radio Frequency (RF) signal, and the phase shifter is an RF phase shifter. The optical oscillator is an optoelectronic oscillator. The RF phase shifter is an optical RF phase shifter, which is defined as an optical component that changes the RF phase of an RF signal that is modulated on its optical carrier. The optical carrier signal includes a first optical carrier signal and a second optical carrier signal. The optical oscillator includes a first tunable optical oscillator for providing the first optical carrier signal and a second tunable optical oscillator for providing the second optical carrier signal. The first frequency-tunable optical oscillator includes a first optical RF phase shifter, while the second frequency-tunable optical oscillator including a second optical RF phase shifter.

The first tunable optical oscillator feeds a differential optical manifold having optical sub-array feeds. The second tunable optical oscillator feeds a corporate manifold having fixed fiber lengths. The first optical RF phase shifter includes a frequency shifter in parallel with an electrically controllable phase controller that is responsive to control signals from a controller. The first optical RF phase shifter exhibits a nested Mach-Zehnder modulator configuration. The second optical RF phase shifter is constructed similarly to the first optical RF phase shifter.

The first frequency-tunable optical oscillator includes a first optoelectronic modulator in a first oscillator loop. The frequency shifter includes parallel phase shifters having RF modulation input. The first oscillator loop includes a first delay line, a first photo detector, a first RF filter, a first RF coupler, and the first tunable optical modulator. The second frequency-tunable optical oscillator includes a second optoelectronic modulator in a second oscillator loop that includes a second delay line, a second photodetector, a second RF filter, a second RF coupler, and the second frequency-tunable optical oscillator.

In the illustrative embodiment, the second tunable optical oscillator further includes an additional output optical RF phase shifter responsive to modulation input from the RF coupler and responsive to a control signal from the controller. An optical carrier signal generated by a laser is responsive to control input from a controller. The controller runs algorithms to selectively adjust phase of the second optical carrier signal to impart phase coding to the second optical carrier signal.

The novel design of one embodiment of the present invention is facilitated by use of a unique modified optical oscillator employing an optical RF phase shifter that contains a nested Mach-Zender modulator in its configuration and that provides turning of the microwave frequency of the optical oscillator. Use of this unique optical oscillator to efficiently provide a desired low noise RF signal modulated on an optical carrier to an antenna array, provides the capability to change the microwave phases of the signals that feed the radiators in the array to scan the antenna array beam without any phase shifters at each of the array radiator elements. The beam steering is accomplished by using the wide frequency tuning range provided by the optical RF phase shifter incorporated into the optical oscillator.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
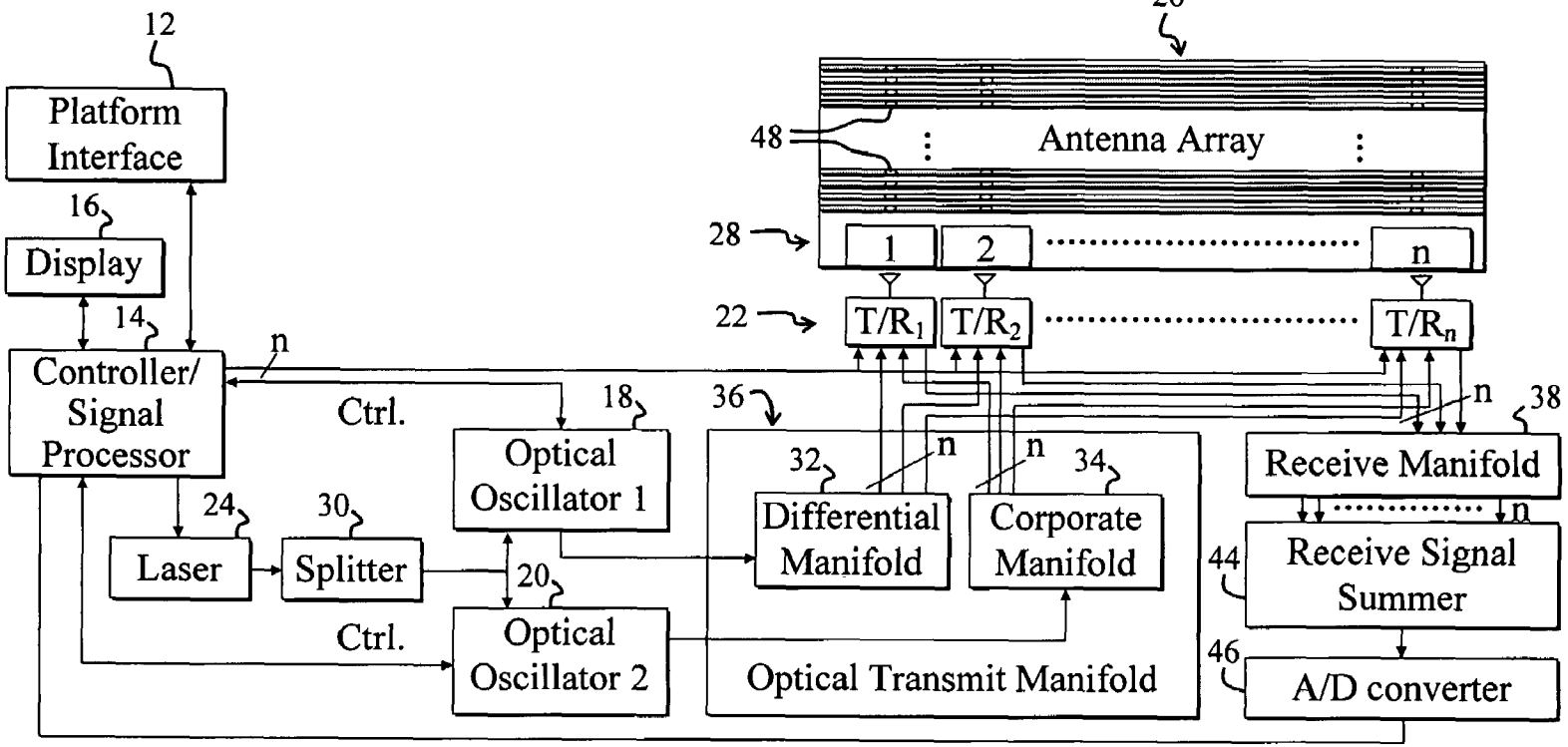
FIG. 1 is a diagram of a photonic frequency scanned active array radar system according to an embodiment of the present invention, which lacks phase shifters at each radiator in the antenna array.

FIG. 1 is a diagram of a photonic frequency scanned active array radar system 10 that is constructed in accordance with the teachings of the present invention and that lacks phase shifters at each radiator in an accompanying array 26. For clarity, various well-known components, such as power supplies, cooling systems, and so on, have been omitted from the figures. However, those skilled in the art with access to the present teachings will know which components to implement and how to implement them to meet the needs of a given application.

The radar system 10 includes a platform interface 12 that communicates with a controller/processor 14, which communicates with a display 16. The controller/signal processor 14 communicates with a first frequency-tunable optical oscillator 18 and a second frequency-tunable optical oscillator 20. The controller/signal processor 14 also provides control input to n transmit/receive (T/R) modules 22 and to a laser 24. The n T/R modules 22 send and receive signals to and from an active antenna array 26 via n corresponding antenna ports 28.

In the present specific embodiment, the active antenna array 26 is a Continuous Transverse Stub (CTS) antenna array, which is known in the art and may be purchased from Raytheon Company. CTS antennas are discussed more fully in co-pending U.S. Pat. No. 5,266,961, entitled CONTINUOUS TRANSVERSE STUB ELEMENT DEVICES AND METHODS OF MAKING SAME, which is incorporated herein by reference.

The laser 24 provides a laser beam to a beam splitter 30 for use as an optical carrier. The splitter 30 outputs a laser beam to the first optical oscillator 18 and the second optical oscillator 20, which provide input to a differential manifold 32 and a corporate manifold 34, respectively, of a transmit manifold 36. The differential manifold 32 provides n different inputs to the n corresponding T/R modules 22. Similarly, the corporate manifold 34 provides n equal inputs to the n corresponding T/R modules 22.

A receive manifold 38 receives n different inputs from the n corresponding T/R modules 22 and provides n corresponding inputs to a receive signal summer 44. The receive signal summer 44 provides input to an Analog-to-Digital (A/D) converter 46, which provides input to the controller/signal processor 14.

An active array typically uses a RF phase shifter at each radiator element to steer the array beam. A CTS antenna array, such as the antenna array 26, uses fewer RF phase shifters to steer its array beam. Use of the frequency tuning in the present embodiment to steer any array beam eliminates the need for phase shifters at each array radiator. Thus, an array implemented using the present teachings may eliminate all the RF phase shifters and accompany hardware typically needed to steer the array beam.

In the present embodiment, the array beam is steered by changing the RF phase of the microwave signal input to each array radiator at antenna ports 28. This RF phase change occurs in response to changing the microwave frequency of antenna feed signals travelling in unique antenna feeds between the oscillators 18, 20 and radiating ports 28 as discussed more fully below. The microwave frequency changes (or turning) used to steer the array beam are generated using the optical oscillators 18, 20. Unique optical RF phase shifters are incorporated into the optical oscillators 18, 20 as discussed more fully below. These optical RF phase shifters selectively change the microwave frequency (i.e., RF) of the optical oscillators 18, 20 to thereby generate microwave frequency changes in the RF signals that are modulated on optical carrier signals output from the oscillators 18, 20. The outputs of the oscillators 18, 20 are optical signals with the RF signals modulated thereon. Hence, the optical oscillator output signals act as optical carrier signals.

For the purposes of the present discussion, an optical RF phase shifter is defined as an optical component that changes the RF phase of an RF signal that is modulated on an optical carrier signal. Unique use of optical RF phase shifters in the present embodiment enables rapid changes in the RF frequencies of the oscillators 18, 20. Hence, an antenna array, such as the antenna array 26, which is beam steered in accordance with the present teachings, can be steered very quickly. Furthermore, since the optical oscillators 18, 20 generate low-noise and low-power microwave frequency signals modulated on optical carrier signals, the overall RF system 10 will exhibit low noise and rapid beam-steering capabilities.

In operation, the laser 24 provides an optical carrier to the first and second oscillators 18, 20 via the optical splitter 30. The first and second optical oscillators 18, 20 modulate a Radio Frequency (RF) or millimeter wave signal on the optical carrier based on control information received from the controller/signal processor 14. The controller/signal processor 14 may be implemented as a computer running various software that may be constructed by one skilled in the art with access to the present teachings or is otherwise already known in the art.

The first and second oscillators 18, 20 provide modulated optical signals to the differential manifold 32 and the corporate manifold 34 of the optical transmit manifold 36, respectively. When the radar system 10 is steering the antenna array 26 in azimuth, i.e., is implementing an azimuth scan of the antenna array 26, the outputs of the first and second optical oscillators 18, 20 track each other in frequency. The frequency of the modulated optical signal output from the second optical oscillator 20 is offset by a predetermined amount from the frequency output from the first optical oscillator 18.

The frequencies of the modulated optical signals output from the first and second optical oscillators 18, 20 are adjusted so that a desired total frequency may be radiated from the antenna array 26 even as the frequency output from the first optical oscillator 18 is adjusted for azimuth scanning.

Scanning the antenna array 26 by adjusting the modulation frequency of the first optical signal output by the first optical oscillator 18 to effect phase changes at the outputs of the differential manifold 32 is also called phase scanning.

The differential manifold 32, which receives the modulated optical input signal from the first optical oscillator 18, feeds the modulated optical input signal into plural optical waveguides, such as fiber optics, that each have different lengths. The lengths are chosen so that a progressive phase relationship exists between signals output from the different optical waveguides, which are called differential feeds for the purposes of the present discussion. As the frequency of the modulated optical input signal is changed to beam-point, i.e., scan the output of the active array 26 in response to control signals received from the controller/signal processor 14, the progressive phase relationship is maintained. As is known in the art, such a progressive phase relationship is required for scanning of an antenna array. In steering an array, the relative phases of the signals radiated or received by antenna elements control the effective beam-pointing direction. The equation for calculating the phase shift in terms of the pointing angle, element separation, and carrier frequency (wavelength) is:

$$\varnothing_n=(2\pi d\sin(n-1))/\lambda, \quad [1]$$

where $\lambda$ is the wavelength of the excitation signal and is equal to c/f; $\varnothing_n$ is the phase shift for element n, n is an integer that varies from 1 to m; m is the number of radiating elements; c is the velocity of the radio frequency signal in air; and f is the frequency of the excitation signal. Each phase shifter provides signals to and receives signals from its corresponding antenna element. A pointing angle is established by imparting an appropriate phase shift to the transmit and receive signals at each phase shifter. The RF (radio frequency) wavefront represents a line along which signals transmitted from or received at each of the antenna elements will line up in phase. The beam-pointing direction is perpendicular to the RF wavefront. The beam-pointing direction and RF wavefront define a beam-pointing angle $\theta$ relative to the plane of the antenna elements, i.e., the array broadside or boresight. An effective beam-pointing angle is established for transmit and receive signals by applying an appropriate phase shift to the signals as they are transmitted or received by elements in the array. The phase shift calculated using the above equation will be a progressive phase shift in that the phase at each radiating element will be incremented by the integer n that varies from 1 to m.

In the following, antenna beam pointing for the CTS antenna 10 is described for azimuth scanning using progress phase out of each T/R module 22. Elevation beam steering is obtained by using frequency to generate a progressive phase to obtain beam steering. Similar beam steering can be obtained if the CTS antenna 10 is rotated so the azimuth dimension becomes the elevation dimension.

The n differential feeds implemented via the differential manifold 32 provide n corresponding inputs to the n respective T/R modules 22. Each of the n inputs have different phases required to establish the progressive phase relationship required for azimuth scanning of the CTS antenna array 26. The number of antenna array elements n, which corresponds to the number of T/R modules 22; the number of differential feeds; and the number of corporate feeds, is application specific and may be determined by one skilled in the art to meet the needs of a given application.

The corporate manifold 34 receives input from the second optical oscillator 20 and splits the input into n corporate feeds. The n corporate feeds have the same lengths, which result in the same phases at the outputs of the n corporate feeds. The outputs of the n corporate feeds provide input to the n T/R modules 22, respectively.

The n T/R modules 22 include mixers, filters, amplifiers, and so on, required to detect and mix inputs from the differential manifold 32 and the corporate manifold 34. The T/R modules 22 detect, i.e., convert optical signals received from the manifolds 32, 34 into microwave signals, which are provided to the antenna ports 28 in preparation for transmission via the antenna array 26, which transmits from radiating ports 48. The aperture of the antenna array 26 faces outward from the page. Various antenna array elements are fed by the antenna ports 28 and act as travelling wave feeds, which radiate specific amounts of radiation from each of the radiating ports 48.

The T/R modules 22 also include a mixer that employs transmit frequencies to mix down received signals to Intermediate Frequency (IF) or baseband signals. The IF or baseband signals are then input to the receive manifold 38. The receive manifold 38 may include circuitry, such as amplifiers, gain control circuits, and so on to prepare the received signals for coherent summing. The exact details of the receive manifold 38 are application-specific and may be determined by one skilled in the art to meet the needs of a given application. The receive manifold 38 may be omitted without departing from the scope of the present invention.

The receive signal summer 44 coherently adds n receive signals, which correspond to receive signal outputs from the n T/R modules 22. The resulting sum signal is an analog signal that is converted to a digital signal via the A/D converter 46. The A/D converter 46 then provides a digital receive signal as input to the controller/signal processor 14.

The controller/signal processor 14 may employ input from the A/D converter 46 to display target information via the display 16. The controller/signal processor 14 may also provide target information to the platform interface 12. Furthermore, the controller/signal processor 14 may employ receive signal information obtained from the A/D converter 46 as input to an algorithm for beam pointing the antenna array 26.

To beam point, i.e., scan or steer the antenna array 26 in azimuth, the controller/signal processor 14 adjusts the modulation frequency of the optical oscillator 18, which changes the phase relationship between differential feed outputs of the differential manifold 32. The phase relationships change predictably with frequency since the differences between lengths of the differential feeds of the differential manifold 32 are predetermined and progressive. Changes in signal phases input to the different T/R modules 22 result in corresponding changes in the resultant beam of microwave or millimeter wave electromagnetic energy output from the antenna array 26.

The modulation frequency output from the second optical oscillator 20 tracks the modulation frequency of the output of the first optical oscillator 18. The differential feeds of the differential manifold 32 and the corporate feeds of the corporate manifold 34 feed signals with adjusted modulation frequencies to the T/R modules 22. The T/R modules 22 convert the optical signals from the optical transmit manifold 36 to microwave signals, which scan the antenna array 26 in azimuth by a predetermined amount corresponding to the change in modulation frequency output from the first optical oscillator 18.

The frequency (first frequency) output by the first optical oscillator 18 and frequency (second frequency) generated by the second optical oscillator 20 are set so that mixing of the first frequency and the second frequency produces a constant output frequency from the antenna array 26 when scanning the antenna array 26 in azimuth. Consequently, the antenna radiated frequency remains constant, independent of changes in the first frequency, which is selectively adjusted to scan in azimuth.

The antenna array 26 is scanned in elevation by selectively adjusting the modulation frequency of the signals output by the corporate manifold 34. The modulation frequency of signals output by the corporate manifold 34 are adjusted by the controller/signal processor 14 via the second optical oscillator 20. When scanning the antenna array 26 in elevation, the frequency of the total output radiation from the antenna array 26 is changed by changing the frequency from the second oscillator, 20.

Those skilled in the art will appreciate that the antenna array 26 may be rotated to switch elevation and azimuth scanning implemented in part via the differential manifold 32 and the corporate manifold 34, respectively. For the purposes of the present discussion, the terms azimuth and elevation refer to two different antenna dimensions, such as horizontal and vertical dimensions, respectively. These dimensions may be interchanged without departing from the scope of the present invention. Instances of the term elevation could be replaced with the term azimuth and visa versa, and the present discussion would remain applicable.

The present invention employs certain antenna scanning methods related to those disclosed in the above-referenced U.S. Pat. No. 5,933,113. However, the radar system disclosed in the above-reverenced patent does not employ voltage-tuned optical oscillators to generate optical signals having high-frequency microwaves or millimeter waves modulated thereon.

Hence, the radar system 10 facilitates beam steering using the continuous transverse active array 26 at high microwave frequencies via fiber optic manifolds 32, 34 and electrical signal manifolds (outputs of T/R modules) 22 that feed the active array 26 with inputs from the fiber optic voltage tunable microwave oscillator sources 18, 20. The radar system 10 can be frequency scanned to produce phase scans in both azimuth and elevation and does not require conventional individual phase shifters. It should be understood that in both cases frequency scanning is used to get phase scanning (or beam pointing). The frequency scan produces phase scanning in azimuth with a different technique than is used to obtain elevation phase scanning in the CTS antenna 10.

The frequency of the first and second oscillators 18, 20 is changed in response to control signals from the controller/signal processor 14 to produce a progressive phase in the array manifold antenna feed (outputs of T/R modules) 22 to beam steer the array 26. The radar system 10 may incorporate metamorphic high-energy mobility transistors (MHEMT) and microelectromechanical (MEMS) technologies where appropriate. The T/R modules 22 employ the transmit signal to provide the signal needed for downconverting the receive signal.

This radar system 10 employs many different techniques to reduce antenna feed losses and reduce component sizes, which reduces antenna system design constraints. The techniques include using the optical transmit manifold 36, which exhibits negligible fiber manifold loss and is small relative to conventional waveguide antenna feeds. The use of optical frequency sources (optical oscillators) 18, 20 and optical manifolds 32, 34 to steer the CTS antenna array 26 result in various above-mentioned advantages afforded by embodiments of the present invention.

The radar system 10 is a photonically frequency generated scanned active array radar system. The CTS antenna array 26 has transmit/receive (T/R) modules 22 that provide the typical active array T/R characteristics, including higher power transmit signal and low noise receive signal, but do not have phase shifters for beam steering either on transmit or receive. The beam steering is supplied by the two optical oscillators 18, 20, which feed the two optical manifolds 32, 34. Outputs of the T/R modules 22 are scanned in the receive manifold 38, and the antenna array 26 is controlled via the controller/signal processor 14. The receive manifold 38 may be implemented via a control manifold. The outputs of the received manifold 38 are summed by the receive signal summer 44 and scanned to form a sum receive signal that is then digitized in the A/D converter 46 and transferred to the signal processor/controller/signal processor 14 and then to the display 16.

The radar system 10 may be constructed by one skilled in the art with access to the present teachings without undue experimentation.

Figure 2:
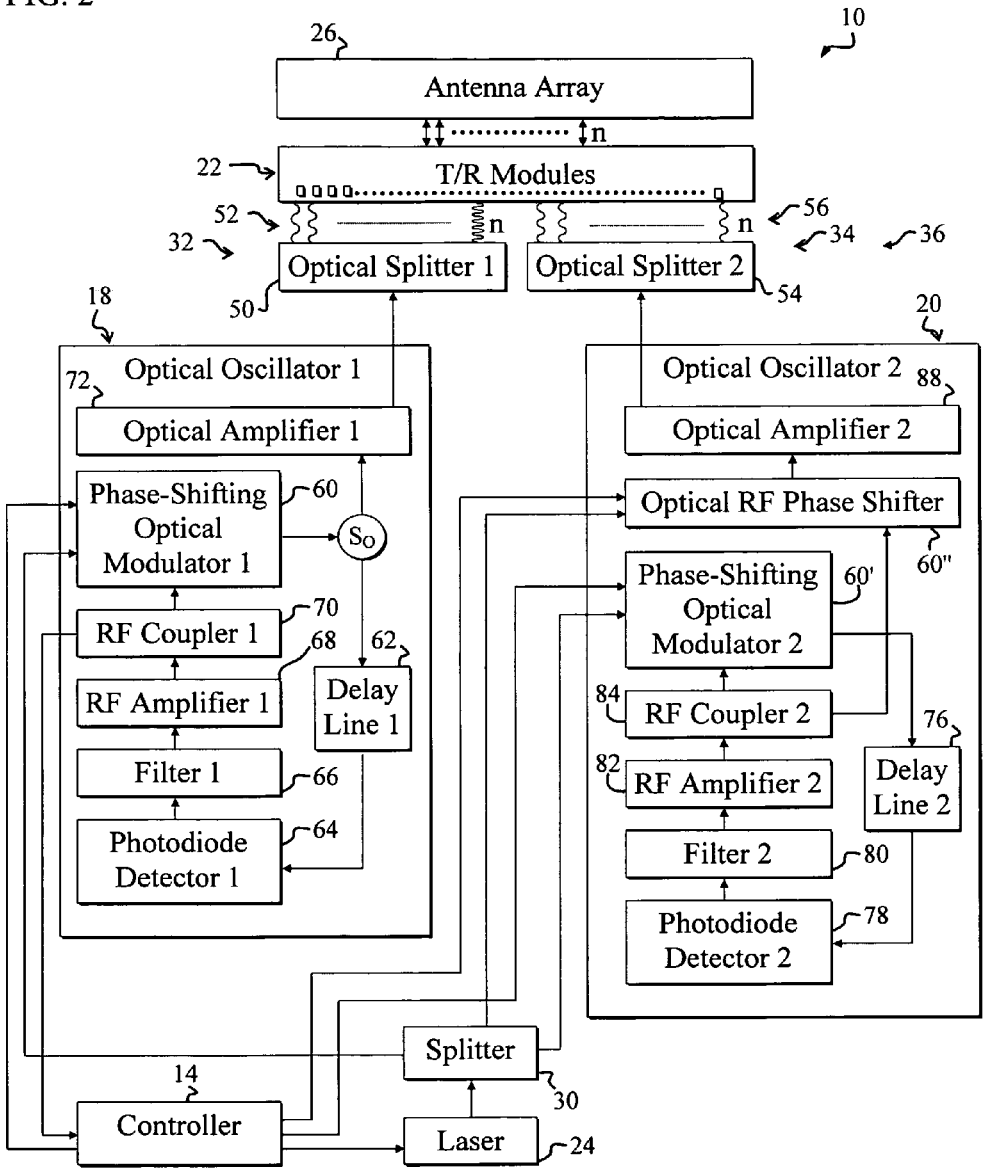
FIG. 2 is a more detailed diagram illustrating the optical oscillators and optical transmit manifolds of the active array radar system of FIG. 1.

FIG. 2 is a more detailed diagram illustrating the optical oscillators 18, 20 and the optical transmit manifold 36 of the active array radar system of FIG. 1. The antenna array 26 is fed by inputs from the n T/R modules 22. Each T/R module 22 receives one of n inputs from the differential manifold 32 and one of n inputs from the corporate manifold 34 of the optical transmit manifold 36.

The differential manifold 32 includes a first optical splitter 50, which splits an optical input from the first optical oscillator 18 into n optical waveguide feeds 52 of different lengths. The optical waveguide feeds 52 are called differential feeds, since their lengths differ by small amounts required to achieve the requisite progressive phase relationship between feed outputs required for azimuth scanning. Changing the frequency of the first optical signal input from the first optical oscillator 18 changes the phases in the differential feeds 52 and thereby steers the antenna array 26 in azimuth.

The corporate manifold 34 includes a second optical splitter 54, which splits an optical input from the second optical oscillator 20 into n optical waveguide feeds 56 of equal lengths. The optical waveguide feeds 56 are called corporate feeds, since their lengths are equal. Changing the frequency of the second optical signal output from the second optical oscillator 20 does not affect azimuth scanning facilitated by the differential manifold 32.

This invention uses one or more optical oscillators 18, 20 that can be frequency tuned using an optical RF phase shifter that is voltage tuned to change its phase. A related optical oscillator (without the optical RF phase shifter) is described in a paper entitled "Optoelectronic Microwave Oscillator", by X. S. Yao and L. Maleki, published in J. Optical Society of America, Vol. 13, No., 8, Aug. 1996, pp. 1725 to 1735. With access to the present teachings, one skilled in the art may construct the optical oscillators 18, 20 without undue experimentation.

The first optical oscillator 18 includes a first special phase-shifting optical modulator 60 (discussed above), delay line 52, photodiode detector 64, RF filter 66, RF amplifier 68, optional RF coupler 70. A first optical amplifier 72 amplifies the optical signal output from the special phase-shifting optical modulator 60 of the optical oscillator 18. The first special phase-shifting optical modulator 60 receives control input from the controller/signal processor 14 and receives an optical carrier signal input from the splitter 30. The first special phase-shifting optical modulator 60 provides output to a first delay line 62 and to the optical amplifier 72 via an output splitter ($S_o$). The output of the first optical amplifier 72 represents the output of the first optical oscillator 18 and is input to the first optical splitter 50 of the optical transmit manifold 36.

The output of the first delay line 62 is fed back as input to the first photodiode detector 64. The output of the first photodiode detector 64, which represents an RF modulated electrical signal, is input to the first filter 66, which is an RF filter. The output of the first RF filter 66 is input to the first RF amplifier 68, an output of which is input to the first optional RF coupler 70. The first optional RF coupler 70 provides an RF electrical output, which may be fed back to the controller/signal processor 14 to facilitate control of the optical oscillator 18. The first optional RF coupler 70 also provides input to the first special phase-shifting optical modulator 60.

The second optical oscillator 20 includes a second special phase-shifting optical modulator 60', delay line 76, photodiode detector 78, RF filter 80, RF amplifier 82 RF coupler 84, output optical RF phase shifter 60", and a second optical amplifier 88. The second special phase-shifting optical modulator 60' receives input from the controller/signal processor 14 and receives an optical carrier input from the splitter 30. An output of the second special phase-shifting optical modulator 60' is input to the second delay line 76, an output of which is input to the second photodiode detector 78. An output of the second photodiode detector 78 is input to the second filter 80, which is an RF filter. An output of the second RF filter 80 is input to a second RF amplifier 82, an output of which is input to the second RF coupler 84. A first output of the second RF coupler 84 is input to the output optical RF phase shifter 60", while a second output of the second RF coupler 84 is input to the second special phase-shifting optical modulator 60'. The output optical RF phase shifter 60" receives an optical carrier signal from the splitter 30 and provides input to the second optical amplifier 88. The output of the second optical amplifier 88 represents the output of the second optical oscillator 20 and is input to the second optical splitter 54 of the corporate feed 34 of the optical transmit manifold 36.

To construct suitable special phase-shifting optical modulators 60, 60', the phase RF shifter described in the above-referenced paper by X. S. Yao and L. Maleki (see FIG. 6 of X. S. Yao and L. Maleki), is omitted. Instead, the phase-shifting optical modulators 60, 60' may impart a desired phase shift to the optical signal that is output by the modulators 60, 60', as discussed more fully.

Those skilled in the art with access to the present teachings may construct a phase-shifting optical modulator without undue experimentation. Additional theory pertaining to the operation of an optical RF phase shifter, which may be employed to implement the phase-shifting optical modulators 60, 60' and the optical RF phase shifter 60" is discussed in a paper entitled, "Demonstration of a Photonically Controlled RF Phase Shifter", by S.-S. Lee, A. H. Udupa, H. Erlig, H. Zhang, Y. Chang, C. Zhang, D. H. Chang, D. Bhaltacharay, B. Tsap, W. H. Steier, L. R. Dalton, H. R. Fetterman, and published in IEEE Microwave and Guided Wave Letters, Vol. 9, No. 9, Sep. 1999, pp. 357 to 359.

The above-referenced papers detail additional teachings, which are known in the art, to facilitate construction of the special phase-shifting optical modulators 60 and 60' and the output optical RF phase shifter 60" of FIG. 2 in accordance with the teachings of the present invention. Each special optical modulator 60, 60' of FIG. 2 combines an optical modulator and phase shifter in one optical circuit 60, 60'. By combining techniques discussed in the above-referenced papers in accordance with the teachings of the present invention, one skilled in the art may construct a frequency-tunable optical oscillator for use with the active array radar 10 without undue experimentation. The various optical components, such as the phase-shifting components 60, 60', 60" exhibit high efficiency, speed, and low dispersion in the microwave frequency regime, which translates into improved antenna performance.

In operation, the first optical oscillator 18 modulates an RF signal, such as a millimeter wave signal, on the optical carrier signal provided by the laser 24 via the splitter 30. The RF modulation is determined based on a control signal received from the controller/signal processor 14. The first special phase-shifting optical modulator 60 is a combined voltage-controlled modulator and optical RF phase shifter that is responsive to changing voltages at the control input.

In the present specific embodiment, the voltage of the input control signal is selectively changed, which thereby changes the phase of the output of the special phase-shifting optical modulator 60. The modulation frequency of the signal output by the optical oscillator 18 then changes based on the change in phase. The RF modulation is facilitated by the delay line 62, which forwards a delayed version of the optical output from the first special phase-shifting optical modulator 60 to the first photodiode detector 64. The first photodiode detector 64 converts the optical output of the first delay line 62 into an electrical RF signal. The electrical RF signal is filtered and amplified by the first RF filter 66 and the first RF amplifier 68 before being fed back to the special phase-shifting optical modulator 60 via the first RF coupler 70. The optical output form the first special phase-shifting optical modulator 60' is amplified by the first optical amplifier 72 before being forwarded to the first optical splitter 50 of the differential manifold 32.

The second optical oscillator 20 generates an RF modulated optical signal via the second special phase-shifting optical modulator 60', the second delay line 76, photodiode detector 78, RF filter 80, and RF amplifier 82, similar to the first optical oscillator 18. However, unlike the first optical oscillator 18, the second RF coupler 84 outputs an RF modulated electrical signal to the output optical RF phase shifter 60", which receives an optical carrier input from the splitter 30. The output optical RF phase shifter 60" facilitates the addition of special modulation, such as phase coding, to the optical carrier with the RF frequency that is output from optical oscillator 20. The phase coding may be employed to implement pulse compression, which may enhance the signal-to-noise ratio of the radar system 10, and may improve range resolution and average radiated power. The output optical RF phase shifter 60" receives voltage inputs from the controller/signal processor 14 to facilitate phase coding.

One skilled in the art with access to the present teachings may construct the optical oscillators 18, 20 without undue experimentation. The optical oscillators 18, 20 may achieve modulation frequencies throughout the microwave band, including the W-band between 80 and 100 GHz.

The differential feeds 52 and the corporate feeds 56 replace conventional bulky and lossy waveguide structures with space-efficient optical waveguides 52, 56 that exhibit minimal signal losses. In addition, the use of the differential delays 52 obviates the need for bulky phase shifters. Furthermore, the use of a single optical laser source 24 helps to ensure that only RF signals modulated on an optical carrier mix in T/R modules 22. In addition, the corporate feeds 56 allow additional phase code modulation to be included in the outputs of the corporate feeds 56. The outputs of the corporate feeds 56 have no effect on azimuth scanning.

The lengths of the corporate feeds 56 are equal. Consequently, changing the modulation frequency of the signals output from the corporate feeds 56 by changing the modulation frequency of the second optical oscillator 20 will not result in different relative phases at the outputs of the corporate feeds 56. Consequently, the second frequency associated with the second optical oscillator 20 may be changed without affecting azimuth scanning implemented in part via the controller/signal processor 14, the first optical oscillator 18, and the differential manifold 32. This allows the additional modulation, such as phase coding, to be added to the output of the second optical oscillator 20.

Furthermore, the CTS antenna array 26 may be scanned in elevation without affecting the azimuth scanning by adjusting the second frequency independent of the first frequency. The fixed frequency offset or difference between the first frequency and the second frequency, which is maintained during azimuth scanning, is not necessarily maintained when scanning in elevation, and thus the radiated frequency will change. It is well known in the art that a CTS active antenna array, such as the antenna array 26, may be scanned in elevation by changing the frequency radiated by the CTS antenna array 26.

The corporate feeds 56 may be replaced with differential feeds 52 without departing from the scope of the present invention. However, in this case, the corporate feeds 56 would not be able to change frequencies without scanning the antenna 10. Consequently, phase coding or wideband modulation placed on the corporate feeds 56 would affect azimuth scanning.

In the present specific embodiment, the optical scanning feed, which corresponds to the output of optical transmit manifold 36, is configured in two separate sections corresponding to the differential feeds 52 and the corporate feeds 56. These feed sections 52, 56 feed the CTS array 26 and facilitate both azimuth scanning and elevation scanning.

Those skilled in the art will appreciate that the CTS antenna array 26 may be replaced with a conventional active array without departing from the scope of the present invention. In this case, the active array may require an additional optical transmit manifold to allow scanning in elevation.

The oscillators 18, 20 employ the special phase-shifting optical modulators 60, 60', which allow voltage frequency tuning of the oscillators 18, 20 via an optical RF phase shifter incorporated as part of the optical modulator 60, 60' in each of the oscillators 18, 20. The oscillators 18, 20 provide a frequency scanning output both as RF on an optical carrier and electrically as an RF signal. The two oscillators 18, 20 feed the CTS antenna array 26 and are voltage controlled to track each other in frequency with a constant frequency offset to obtain the antenna scanning when scanning in a predetermined dimension, such as azimuth.

The first optical oscillator 18 facilitates scanning the antenna 26 by changing the frequency fed through the differential delay feeds 52. The different optical delays to each T/R module 22 of the array 26 produces the progressive RF phase needed for the antenna array phase scanning.

The second optical oscillator 20 supplies another frequency through the corporate optical feeds 56 to each array T/R module 22. The two oscillators 18, 20 track each other so that as the frequency in the differential optical feeds 52 is changed, the frequency in the corporate optical feeds 56 tracks with a constant frequency separation so that mixing the two frequencies always produce the same output frequency. Consequently, the antenna-radiated frequency is always the same and is independent of the scanning frequency change in the differential optical feeds 52.

The use of one of the feeds 52, 56 as a corporate feed 56 allows the signal frequency to be used for changing the radiated frequency without affecting the azimuth scanning provided by the other feed 52. Thus, by changing the transmit frequency through the CTS array 26, the array 26 is frequency scanned in elevation independent of the azimuth scanning. This is because the construction of the CTS array 26 provides a frequency scanning capability in one dimension that can be used for elevation beam scanning. An exemplary frequency-scanning technique is disclosed in U.S. Pat. No. 5,933,113, entitled SIMULTANEOUS MULTIBEAM AND FREQUENCY ACTIVE PHOTONIC ARRAY RADAR APPARATUS, which is incorporated herein by reference.

The basic difference (delta) lengths between the differential feeds 52 provide scanning as the first oscillator 18 changes frequency, thereby producing the progressive phase values to steer the array 26 in azimuth. The embodiment of FIG. 2 does not require use of sub-arrays. However, sub-arrays may be employed without departing from the scope of the present invention. One skilled in the art will know how to adapt the teachings of the present invention for use with sub-arrays and/or serpentine lines without undue experimentation to meet the needs of a given application.

The single laser 24 is used to supply all the optical circuits 18, 20, 36 in the radar system 10. This ensures that only the RF signals modulated on the optical carriers mix in the photodiode detector mixers in the T/R modules 22 and to avoid direct optical signal mixing that could more easily occur if different laser light sources were used.

When azimuth antenna scanning a lone is needed, the two optical manifolds 32, 34 are operated with different frequencies that track each other to allow frequency scanning while radiating the same frequency during the azimuth frequency scan. When elevation scanning is desired, the output transmit frequency can be changed independent of azimuth frequency scanning by changing the frequency in the corporate manifold 34 without the change being tracked in the differential manifold 32.

When a CTS array is used, this change in transmit frequency steers the array 26 in elevation. For combined azimuth and elevation scanning, the frequencies in the optical manifolds 32, 34 can be controlled to allow for this dual scanning. This is because the corporate manifold 34 will not produce an array azimuth phase change when its input frequency is changed.

The use of the CTS array 26 facilitates dual azimuth and elevation scanning via the two optical manifolds 32, 34 via selectively controlling the RF frequency in each manifold 32, 34.

Each feed port 28 of the CTS antenna array 26 launches a signal in the elevation direction (vertical direction in 26 of FIG. 1) that is a travelling wave feed, where the RF energy is radiated at ports along the feed and where there are equal delays between each elevation radiating port 48. This constant delta delay between elevation radiating ports causes a progressive phase to be generated and thus elevation antenna scanning using a change in the transmit frequency is obtained.

To obtain elevation scan in a conventional (not a CTS) antenna array system employing sub-arrays, the array 26 can be divided into major elevation sub-arrays with a microwave phase shifter between each elevation sub-array to provide for elevation scanning. In this case, each elevation sub-array is fed with identical azimuth feeds, each with a microwave phase shifter (not shown).

The radar system 10 uses frequency scanning techniques generated using optical oscillators 18, 20 rather than individual phase shifters to steer the array 26. The optical technique offers advantages over current practice for electronically scanned active array and mechanically scanned arrays. In addition, the optical scanning can be combined at the sub-array level with each sub-array scanned using a microwave serpentine line to provide a combined azimuth scanning using both optical and electrical techniques.

Figure 3:
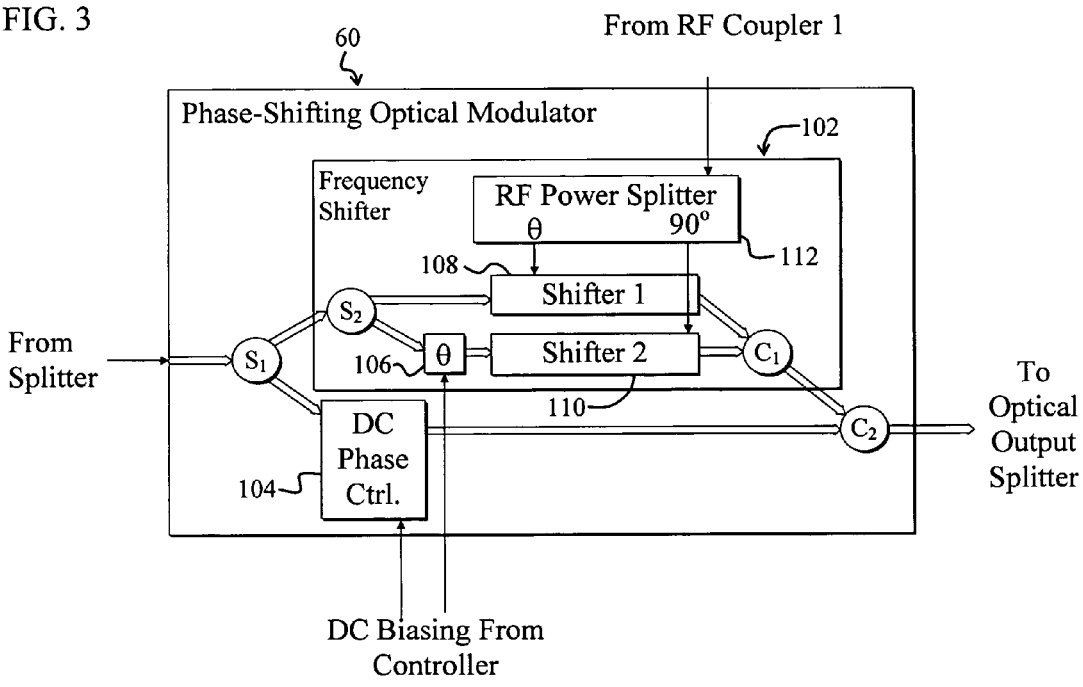
FIG. 3 is a more detailed diagram illustrating an exemplary special phase-shifting optical modulator adapted for use with the optical oscillators of FIG. 2.

FIG. 3 is a more detailed diagram illustrating an exemplary special phase-shifting optical modulator 60 adapted for use with the optical oscillators 18, 20 of FIG. 2. In the present specific embodiment, with reference to FIGS. 2 and 3, the first special phase-shifting optical modulator 60, the second phase-shifting optical modulator 60', and the output optical RF phase shifter 60" of FIG. 2 are implemented via instances of the special phase-shifting optical modulator 60 of FIG. 3.

In case wherein the phase-shifting optical modulator 60' of FIG. 2 is implemented via the special phase-shifting optical modulator 60 of FIG. 3, the controller 14 selectively imparts phase changes to the optical feedback to the second delay line 76 that are sufficient to adjust the output frequency of the second oscillator 20.

Similarly, the output optical RF phase shifter 60" of FIG. 2, which is implemented via the special phase-shifting optical modulator 60 of FIG. 3, may selectively control the phase of the resulting output signal of the second oscillator 20. By selectively controlling the phase of the optical output of the oscillator 20, the optical RF phase shifter 60" imparts desired phase coding to the output signal in response to control signals from the controller 14. By changing the phase of a signal in a predetermined pattern or in accordance with a desired code, additional information may be carried by the signal output from the oscillator 20. This phase coding will appear on the radiated from the antenna array 26.

The exemplary phase-shifting optical modulator 60 includes a frequency shifter 102 in parallel with an electrically controllable phase controller 104. With reference to FIGS. 2 and 3, both the phase controller 104 and the frequency shifter 102 are responsive to control signals from the controller 14 of FIG. 2. A first input splitter ($S_1$) splits the optical carrier signal output from the splitter 30 of FIG. 2 into two optical paths, a first optical path being input to the DC phase controller 104, and the second optical path being input to a second input splitter ($S_2$) of the frequency shifter 102. The frequency shifter 102 includes the second input splitter $S_2$, a DC-biased phase-offset circuit 106, a first optical shifter 108, a second optical shifter 110, an input RF power splitter 112, and a first output combiner ($C_1$). A second output combiner ($C_2$) receives optical input from the first output combiner $C_1$ and combines it with optical output from the DC phase controller 104 to yield the phase-shifted optical output of the phase-shifting optical modulator 60.

The second input splitter $S_2$ splits the first optical output signal of the first input splitter $S_1$ into third and fourth optical output paths. The third optical path provides optical input to the first optical phase shifter 108. The fourth optical path provides optical input to the DC-biased phase-offset circuit 106. The DC-biased phase-offset circuit 106 receives DC-biasing input from the controller 14 of FIG. 2 and imparts a phase shift ($\theta$) to the optical signal input to the DC-biased phase-offset circuit 106 in response thereto. The resulting phase-shifted optical signal output from the DC-biased phase-offset circuit 106 is input to the second optical phase shifter 110, an output of which is input to the first optical combiner $C_1$. The third optical path output from the second input splitter $S_2$ is input to the first optical phase shifter 108, an output of which is input to the first optical combiner $C_1$. The first optical combiner $C_1$ combines optical outputs from the optical phase shifters 108, 110 and inputs the resulting combined optical signal to the second optical combiner $C_2$.

In the present specific embodiment, the DC phase control circuit 104, the phase-offset circuit 106, and the optical phase shifters 108, 110 are optical phase shifters that are implemented via an electro-optical polymer, such as CLD2-ISX. The polymer is in communication with an electrode that receives input from the controller 14 or from the RF couplers 70 and/or 84 of FIG. 2. The electrode is positioned relative to the polymer so that changes in voltage at the electrode yield corresponding changes in the index of refraction of the polymer, which is the optical propagating medium. As is known in the art, the speed of an optical signal in a material is a function of the index of refraction of the material. Accordingly, desired optical phase shifts are obtained by adjusting the speeds of the optical signals in the various components 104-110 via electrical inputs. The CLD2-ISX polymer may be replaced with another material, such as $LiNbO_3$ without departing from the scope of the present invention.

The optical phase shifters 108, 110 facilitate modulating the RF signal input to the frequency shifter from the RF coupler 70 of FIG. 2 upon the optical carrier signal output from the phase-shifting optical modulator 60. By modulating the phases of the signals passing through the optical phase shifters 108, 110 via RF signal that are 90° out of phase (as output from the RF power splitter 112), the resulting combined signal output from the first combiner $C_1$ exhibits desired RF amplitude modulation.

In the present specific embodiment, the DC phase controller 104 and the phase shifter 106 are employed by the controller 14 of FIG. 2 to selectively impart phase changes to the optical feedback to the first delay line 62 that are sufficient to adjust the output frequency of the first oscillator 60. For example, by selectively changing the phase of the optical signal passing through the DC phase control circuit 104, the RF signals input to the first phase shifter 108 and the second phase shifter 110 will be phase shifted accordingly. This phase shift will cause the resulting optical signals travelling through the frequency splitter 102 and the DC phase controller 104 to couple differently at the output of the second optical coupler $C_2$, thereby yielding a different output frequency. Further details of the operation and theory pertaining to phase-shifting optical modulator 60 are discussed in the above-referenced paper entitled "Demonstration of a Photonically Controlled RF Phase Shifter" by Lee et. al.

Use of the phase-shifting optical modulator 60 as both a modulator and a phase shifter to adjust the output frequency of the accompanying oscillator 18 is synergistic. This enables the omission an electric RF phase shifter that would instead be employed after the photodiode detector 64. Accordingly, the oscillator 18 is compact and may exhibit improved signal-to-noise ratio and wider bandwidth characteristics, which will improve the overall operation of the radar system 10.

The various electrically controlled optical phase-phase shifting components 104-110 of the phase shifting optical modulator 60 are electrically controlled. Accordingly, the may be called optoelectronic phase shifters. Furthermore, the phase-shifting optical modulators 60, 60', and 60", and the corresponding optical oscillators 18, 20 may be called optoelectronic components. For example, the first optical oscillator 18 may be considered an optoelectronic oscillator. The term optical is employed in the present discussion (versus optoelectronic) to emphasize that the signal being shifted or operated on is an optical signal.

An optoelectronic modulator configuration employing parallel optical phase shifters is often called a Mach-Zehnder modulator configuration. Accordingly, since the frequency shifter 102 also includes parallel phase shifters 108, 110, the phase-shifting optical modulator 60 exhibits a nested Mach-Zehnder modulator configuration.

Figure 4:
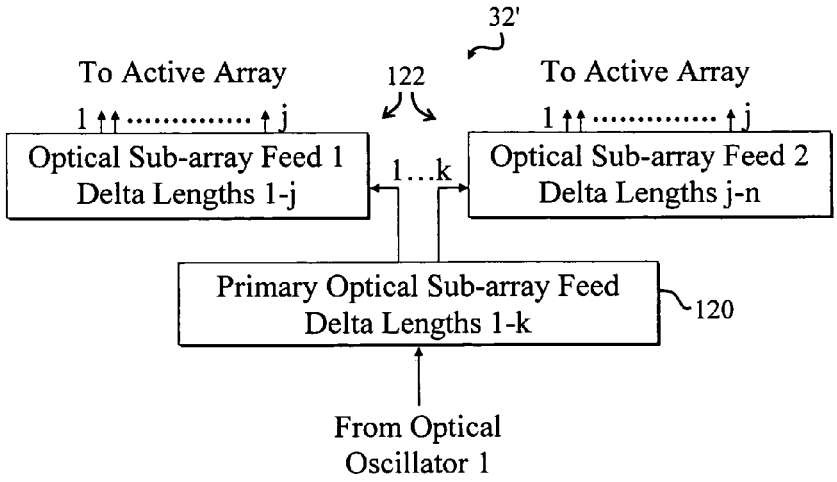
FIG. 4 is a diagram of an alternative embodiment of the differential optical transmit manifold of FIG. 2.

FIG. 4 is a diagram of an alternative embodiment 32' of the differential optical transmit manifold 32 of FIG. 2. The alternative differential manifold 32' is adapted for use with sub-arrays. In the present alternative embodiment, the antenna array 26 of FIGS. 1 and 2 is treated as comprising k secondary sub-arrays, wherein each sub-array has j elements that are fed by progressive phases generated by progressive lengths of fibers, 1 to j.

The alternative differential manifold 32' includes a primary optical sub-array feed 120, which receives the first optical signal from the first optical oscillator 18 of FIGS. 1 and 2 as input and provides outputs to all k sub-arrays 122. The primary optical sub-array feed 120 includes a splitter (not shown) that splits the optical input signal into k optical waveguides of different progressive lengths. There are k secondary sub-arrays 122 that are each fed by a different fiber length from the primary optical feed 120. Each of the k fiber lengths are progressive in length so as to provide the correct phase to the k secondary sub-arrays to provide a continuous progressive phase across the array 26 of FIG. 2.

Thus, the lengths of the k optical waveguides of the primary optical sub-array feed 120 are adjusted so that a desired progressive phase relationship is maintained between the outputs of each optical sub-array feed 122 to facilitate antenna azimuth scanning. Alternatively, the optical waveguides of another set of k optical sub-array feeds (not shown) all have the same lengths to provide the corporate feed frequency to all the T/R modules in the array. Use of such sub-arrays may be useful in applications having large arrays.

The optical sub-array feeds of the present invention can be implemented via serpentine lines instead of or in combination with the optical feeds without departing from the scope of the present invention.

Figure 5:
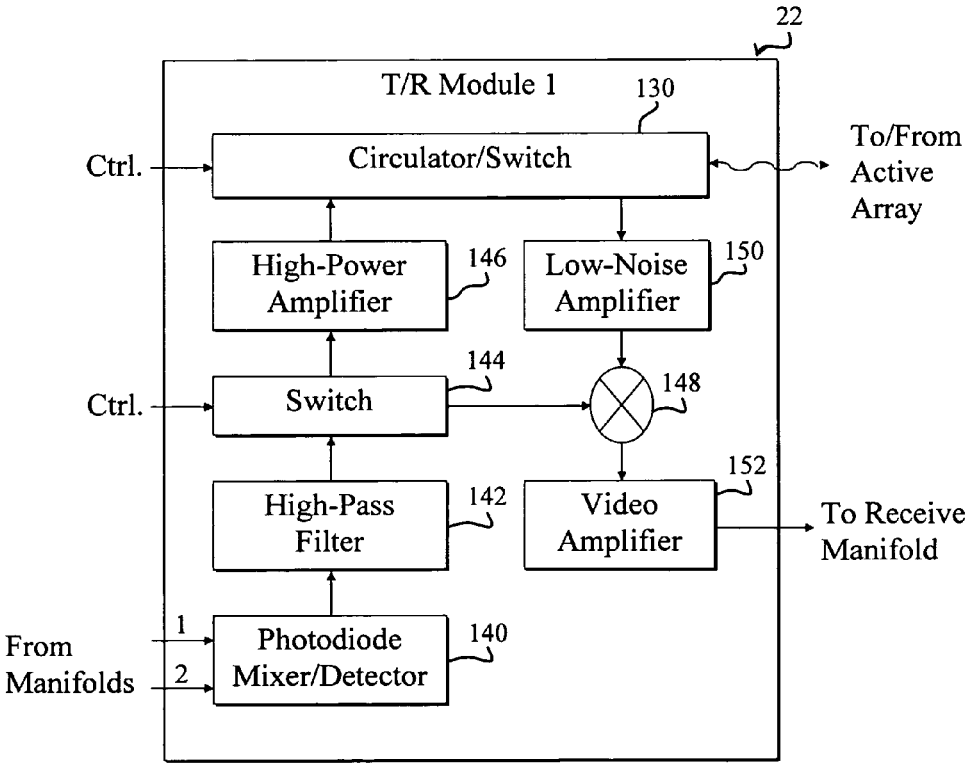
FIG. 5 is a more detailed diagram of a transmit/receive module of the active array radar system of FIG. 1.

FIG. 5 is a more detailed diagram of one of the transmit T/R modules 22 of the active array radar system 26 of FIG. 1. The T/R module 22 includes a photodiode detector/mixer 140, a high-pass filter 142, a switch 144, a high-power amplifier 146, and a switch 130 connected in sequence in a transmit path. The T/R module 22 also includes a low-noise amplifier 150, a downconverter mixer 148, and a video amplifier 152, which are connected in sequence. The MEMS switch 144 is also connected to the downconverter mixer 148.

The photodiode detector/mixer 140 receives the first optical signal from the first optical oscillator 18 and the second optical signal from the second optical oscillator 20 of FIGS. 1 and 2 as input. The photodiode detector/mixer 140 mixes and converts the received optical signals into a RF-modulated output signal. The RF-modulated output signal represents both sum and difference frequencies resulting from the mixing of the optical inputs. Due to the relatively high modulation frequency of the RF signal modulated on the optical inputs, the difference frequency component of the resulting RF-modulated signal is small relative to the sum frequency component. The high-pass filter 142 removes the small difference frequency component. The resulting sum frequency component is input to the switch 144. The switch 144 splits output from the high-pass filter 142 into two separate paths, one to the high-power amplifier 146, and the other path to the downconverter mixer 148. The sum frequency component signal may be employed by the downconverter mixer 148 as a reference oscillator signal to coherently downconvert receive signals received by the antenna array 26 of FIGS. 1 and 2 and transferred to the downconverter mixer 148 via the switch 130 and the low-noise amplifier 150.

The operation of the switch 144 may be controlled via input from the controller/signal processor 14 of FIG. 1. The switch 144 selectively switches the output of the high-pass filter 142 to the input of the high-power amplifier 146 or the downconverter mixer 148 in response to control signals from the controller/signal processor 14 of FIG. 1.

The high-power amplifier 146 amplifies the sum signals output from the switch 144 and forwards an amplified signal to the switch 130. The switch 130 acts as a duplexer or switch that facilitates sharing of the resources of the antenna array (see 26 of FIGS. 1 and 2) between transmit and receive functions. The operation of the switch 130 may be controlled via control signals received from the controller/signal processor 14 of FIG. 1.

With reference to FIGS. 1 and 2, the amplified transmit signal output from the high-power amplifier 146 is forwarded to one of the antenna ports 28 in preparation for transmission from the antenna array 26. In the present illustrative embodiment, the switch 130 provides output to antenna array 26. Receive signals enter the T/R module 22 at the switch 130, which forwards the receive signals to the low-noise amplifier 150. The low-noise amplifier 150 amplifies each input receive signal to yield an amplified receive signal. The amplified receive signal is downconverted to baseband or to a suitable Intermediate Frequency (IF) via the downconverter mixer 148 and the local oscillator signal provided by the switch 144 from the transmit path. The downconverter mixer 148 provides a signal with the conjugate phase of the received signal. This conjugate phase signal that is output from the mixer 148 is generated by switching the RF frequency in the optical manifold (see 36 of FIG. 1) between transmit and receive. The resulting baseband or IF signal is amplified by the video amplifier 152 before being forwarded to the receive manifold 38 of FIG. 1.

The mixing technique involving both detecting and mixing the input optical signals via the photodiode mixer/detector 140 allows the same optical manifold 36 that is used to generate phases to steer the array 26 for transmit to be used to generate the conjugate phases that are applied to the receive signal to facilitate coherent adding via the receive signal summer 44 of FIG. 1. Because the mixing is used to obtain a difference frequency on receive, the mixed phase out of the mixer 140 would not be the conjugate phase needed to cause the received signals to add in phase. To obtain the correct phase on receive, the oscillator signal output from the switch 144 is adjusted in frequency between transmit and receive to generate the correct phase, i.e., conjugate phase, to cause all of the received signals to be summed coherently to obtain the sum RF receive signal output from the receive signal summer 44 of FIG. 1. The frequency associated with the corporate manifold 34 is changed to obtain the correct frequency value needed for mixing to baseband video or IF. The corporate manifold 34 is used since its frequency can be changed without affecting the antenna azimuth scanning provided by the differential manifold 32. This frequency switching can be done fast between transmit and receive and vice-versa.

The receive baseband video or IF manifold (receive manifold) 38 of FIG. 1 can be configured to have an azimuth sum and difference output so that angle data can be provided. Due to the efficient optical components employed in various embodiments of the present invention and the large number of T/R modules that can be operated, the amplifiers 146, 150, 152 may operate at low RF power, which is advantageous, especially at millimeter wave frequencies where very high-power amplifiers are difficult to achieve.

In addition, the optical feeds 52, 56 of FIG. 2 can be used to feed sub-arrays in conjunction with a serpentine waveguide sub-array feeds. In this case, the T/R module 22 of FIG. 5 supplies a frequency-scanned, optically generated progressive phase to each microwave serpentine sub-array (not shown). The optical sub-array feed to the sub-array T/R modules 22 is used with the progressive phase to each microwave serpentine sub-array (not shown). The frequency scanning and both feeds (optical sub-array and microwave sub-array serpentine) are designed so that a frequency scanning of the entire array is generated using one frequency scanning source. The frequency source could be either optical or electrical.

In the present embodiment of FIG. 5, the amplifier components of the T/R module 22 may be implemented using Metamorphic High-Energy Mobility Transistor (MHEMT) technology. The switches 144, 130 may be implemented via microelectromechanical (MEMS) technologies.

Thus, the present invention has been described herein with reference to a particular embodiment for a particular application. Those having ordinary skill in the art and access to the present teachings will recognize additional modifications, applications, and embodiments within the scope thereof. It is therefore intended by the appended claims to cover any and all such applications, modifications and embodiments within the scope of the present invention.

Accordingly,

What is claimed is:

1. A system for scanning an antenna array comprising:

first means for modulating a desired signal on an optical carrier signal, said first means including a frequency-tunable optical oscillator with a phase shifter for changing an output frequency of said optical oscillator;

second means for employing said optical carrier signal to derive feed signals having predetermined phase relationships; and third means for receiving said feed signals and radiating corresponding transmit signals in response thereto to said antenna array to steer said array.

2. The system of claim 1 wherein said desired signal is a Radio Frequency (RF) signal, and wherein said phase shifter is an RF phase shifter.

3. The system of claim 2 wherein said optical oscillator is a frequency-tunable optoelectronic oscillator.

4. The system of claim 2 wherein said RF phase shifter is an optical RF phase shifter.

5. The system of claim 4 wherein said optical carrier signal includes a first optical carrier signal and a second optical carrier signal.

6. The system of claim 5 wherein said optical oscillator is an optical oscillator that includes a first tunable optical oscillator for providing said first optical carrier signal and a second tunable optical oscillator for providing said second optical carrier signal, said first frequency-tunable optical oscillator including a first optical RF phase shifter, said second Frequency-tunable optical oscillator including a second optical RF phase shifter.

7. The system of claim 6 wherein said first tunable optical oscillator feeds a differential optical manifold having optical sub-array feeds, and wherein said second tunable optical oscillator feeds a corporate manifold having fixed fiber lengths.

8. The system of claim 6 wherein said first optical RF phase shifter includes a frequency shifter in parallel with an electrically controllable phase controller, said phase controller responsive to control signals from a controller.

9. The system of claim 8 wherein said first optical RF phase shifter exhibits a nested Mach-Zehnder modulator configuration.

10. The system of claim 8 wherein said second optical RF phase shifter is constructed similarly to said first optical RF phase shifter.

11. The system of claim 6 wherein said first frequency-tunable optical oscillator includes a first optoelectronic modulator in a first oscillator loop.

12. The system of claim 11 wherein said frequency shifter includes parallel phase shifters having RF modulation input.

13. The system of claim 11 wherein said first oscillator loop includes a first delay line, a first photo detector, a first RF filter, a first RF coupler, and said first tunable optical modulator.

14. The system of claim 6 wherein said second frequency-tunable optical oscillator includes a second optoelectronic modulator in a second oscillator loop.

15. The system of claim 14 wherein said second oscillator loop includes a second delay line, a second photodetector, a second RF filter, a second RF coupler, and said second frequency-tunable optical oscillator.

16. The system of claim 15 wherein said second tunable optical oscillator further includes an additional output optical RF phase shifter responsive to modulation input from said RF coupler; responsive to control input from a controller; and responsive to optical input from a laser.

17. The system of claim 16 wherein said controller implements means for selectively adjusting phase of said second optical carrier signal to impart phase coding to said second optical carrier signal.

18. The system of claim 1 wherein said first means includes a phase shifter for selectively adding coding to an optical signal input to said third means.

19. The system of claim 18 wherein said antenna array is a continuous transverse stub array.

20. The system of claim 19 wherein said antenna array is a continuous transverse stub active antenna array.

21. The system of claim 20 wherein said third means includes optical sub-arrays having one or more serpentine lines.

22. An radar system comprising:

a continuous transverse stub antenna array;

an optical oscillator that generates an optical signal oscillating at a predetermined frequency, said optical oscillator including a phase-shifting optical modulator;

an optical manifold that employs said optical signal to derive feed signals having progressive phase relationships; and optical transmit modules that each receive one of said feed signals and output corresponding electrical signals in response thereto to said antenna array.

23. The system of claim 22 wherein said optical oscillator is a voltage tuned oscillator that may change a frequency of said optical signal in response to a control signal.

24. The system of claim 22 wherein said phase-shifting optical modulator is coupled in a feedback loop having an optical section and an electrical section with a photodiode detector therebetween.

25. The system of claim 22 wherein said phase-shifting optical modulator exhibits a nested Mach-Zehnder configuration.

26. The system of claim 22 further including one or more optical sub-arrays exhibiting one or more optical fibers exhibiting different lengths and plural optical fibers exhibiting similar lengths positioned between said optical transmit modules and said antenna array.

27. The system of claim 26 wherein said plural optical fibers exhibiting similar lengths carry optical signals with coding modulated thereon.

28. The system of claim 27 wherein said coding is pulse compression coding.

29. The system of claim 27 wherein said optical oscillator includes an output optical phase shifter responsive to control signals from said controller for modulating said phase coding on said optical signals.

30. The system of claim 22 wherein said optical manifold includes a first optical manifold for scanning said active array in a first dimension and a second manifold for scanning said active array in a second dimension.

31. The system of claim 30 wherein said first dimension is azimuth, and wherein said second dimension is elevation.

32. The system of claim 22 wherein said optical oscillator includes a first optical oscillator and a second optical oscillator for feeding said first optical manifold and said second optical manifold, respectively.

33. A method for scanning an antenna array having plural elements comprising the steps of:

modulating a desired signal on an optical carrier signal via a frequency-tunable optical oscillator with a phase shifter;

employing said optical carrier signal to derive feed signals having predetermined phase relationships; and receiving said feed signals and radiating corresponding transmit signals in response thereto to said antenna array to steer said array.

* * * * *